US006898881B2

(12) United States Patent
Morrison

(10) Patent No.: US 6,898,881 B2
(45) Date of Patent: May 31, 2005

(54) PRODUCT QUANTITY INDICATOR TAB

(76) Inventor: Jane Morrison, 7204 Corregidor Rd., Vancouver, WA (US) 98664

( * ) Notice: Subject to any disclaimer, the term of this patent is extended or adjusted under 35 U.S.C. 154(b) by 0 days.

(21) Appl. No.: 10/444,695

(22) Filed: May 23, 2003

(65) Prior Publication Data

US 2003/0221348 A1 Dec. 4, 2003

Related U.S. Application Data

(60) Provisional application No. 60/384,260, filed on May 29, 2002.

(51) Int. Cl.[7] ..... G09K 13/00; G09F 3/10

(52) U.S. Cl. ..... 40/299.01; 40/630; 116/200

(58) Field of Search ..... 40/229.01, 630, 40/638; 242/563.2, 459.5, 459.1, 395, 396, 397, 408, 409, 912, 160.1; 116/200, 201; 206/232, 459.5, 459.1, 395, 396, 397, 408, 409

(56) References Cited

U.S. PATENT DOCUMENTS

| | | | | | |
|---|---|---|---|---|---|
| 2,094,454 | A | | 9/1937 | Keville | 206/59 |
| 2,329,527 | A | | 9/1943 | Golub | 206/59 |
| 2,853,042 | A | | 9/1958 | Rivkin | 116/114 |
| 3,423,038 | A | | 1/1969 | Katzhef et al. | 242/55.13 |
| 3,836,044 | A | * | 9/1974 | Tilp et al. | 221/55 |
| 4,101,026 | A | * | 7/1978 | Bonk | 206/205 |
| 4,161,249 | A | | 7/1979 | Dashow | 428/156 |
| 4,289,250 | A | | 9/1981 | Jordan | 220/269 |
| 4,887,110 | A | | 12/1989 | Harvey | 354/275 |
| 4,901,663 | A | | 2/1990 | DeLuca | 116/200 |
| 5,123,343 | A | | 6/1992 | Willer | 101/23 |
| 5,156,297 | A | | 10/1992 | Engler | 222/23 |
| 5,365,874 | A | | 11/1994 | Dorfman | 116/200 |
| 5,368,188 | A | | 11/1994 | Twardowski | 221/50 |
| 5,427,298 | A | | 6/1995 | Tegtmeier | 227/120 |
| 5,478,279 | A | | 12/1995 | McCormick | 462/25 |
| 5,507,425 | A | | 4/1996 | Ziglioli | 227/120 |
| 5,538,587 | A | | 7/1996 | Sakano et al. | 156/505 |
| 5,588,219 | A | | 12/1996 | Seabrooks | 33/733 |
| 5,802,974 | A | | 9/1998 | McNeil | 101/226 |
| 5,816,165 | A | | 10/1998 | Huston | 101/490 |
| 5,820,730 | A | | 10/1998 | Phan et al. | 162/112 |
| 5,829,790 | A | | 11/1998 | Phillips | 283/17 |
| 5,903,869 | A | | 5/1999 | Jacobson et al. | 704/272 |
| 5,950,319 | A | | 9/1999 | Harris | 33/494 |
| 5,992,724 | A | | 11/1999 | Snyder | 227/120 |
| 6,089,483 | A | | 7/2000 | St-Laurent | 242/160.4 |
| 6,113,148 | A | | 9/2000 | Koranda | 283/81 |
| 6,221,211 | B1 | | 4/2001 | Hollenberg et al. | 162/123 |
| 6,257,410 | B1 | | 7/2001 | Ulmann et al. | 206/389 |
| 6,282,807 | B1 | * | 9/2001 | Johnson | 33/733 |
| 2004/0003521 | A1 | * | 1/2004 | Penn et al. | 40/299.01 |

* cited by examiner

*Primary Examiner*—Cassandra Davis
(74) *Attorney, Agent, or Firm*—Jane M Morrison

(57) ABSTRACT

A discreet removable chronological group indicator tab placed on a product at a predetermined depletion level. The tab appears on the product to notify the consumer the product needs replacement before its actual depletion. The tab has indicia that states the exact number of product left. Once the tab appears, the tab is then intended to be removed from the product and attached to the side of the product dispenser as a noticeable reminder, placed in a wallet, or on a shopping list. The indicator tab bears the name or image of the product. The tab has a removable coupon with a UPC bar code attached to it that will encourage the consumer to replace the exact same product. This device enables a consumer to readily determine the exact type of product needing replenishment with the convenience of replacement before its actual depletion.

14 Claims, 2 Drawing Sheets

FIG. 1
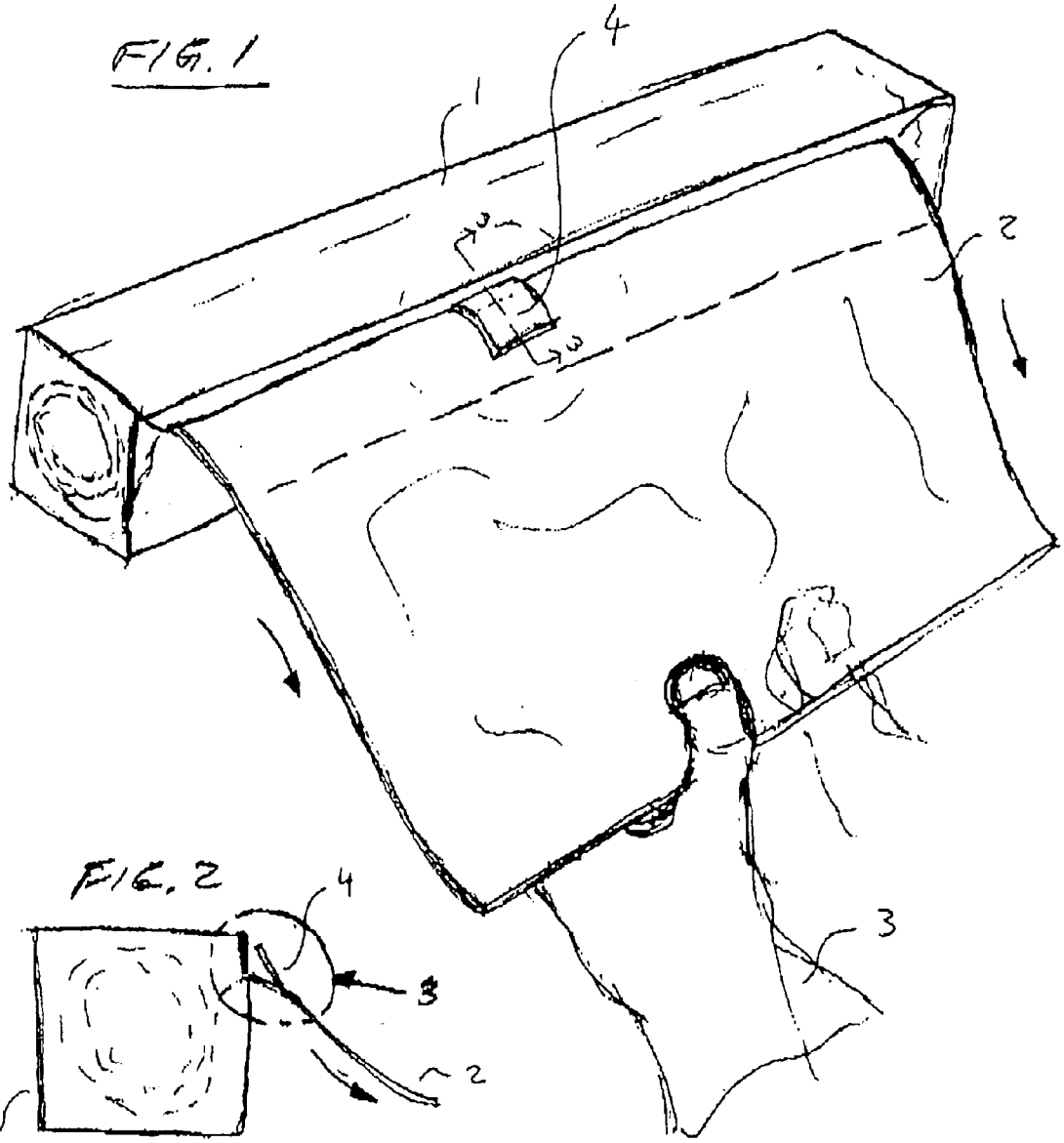
FIG. 2
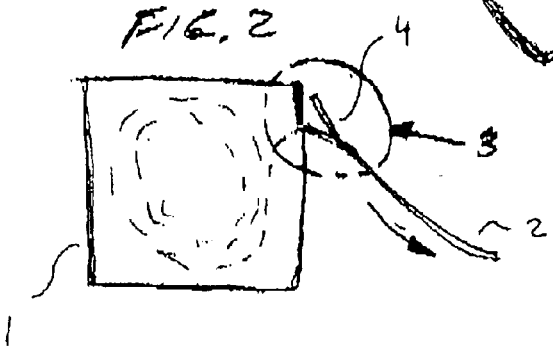
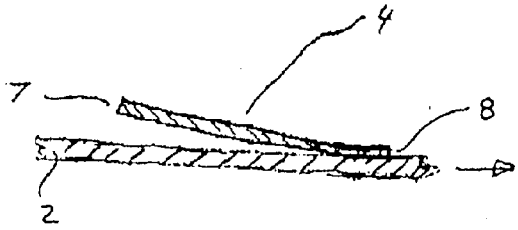
FIG. 3

FIG. 4
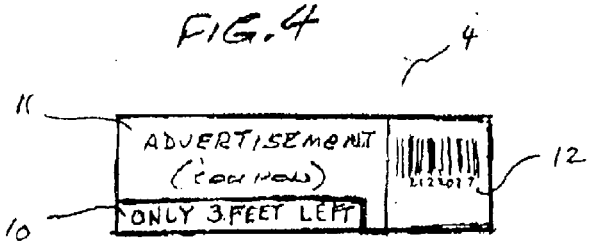
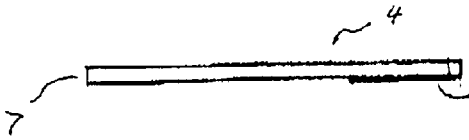
FIG. 5
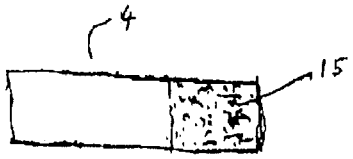
FIG. 6
FIG. 7
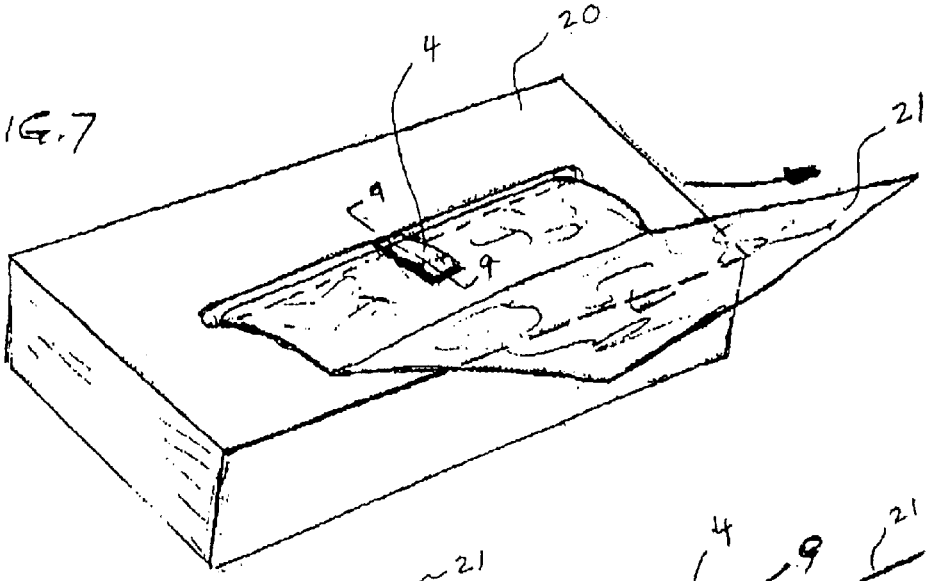
FIG. 9
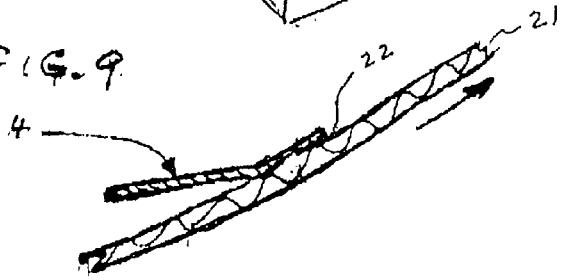
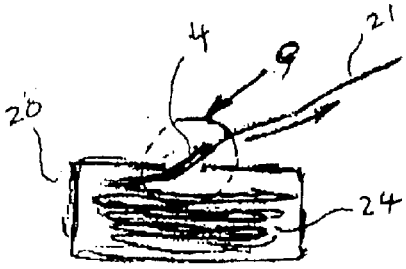
FIG. 8

PRODUCT QUANTITY INDICATOR TAB

RELATED APPLICATIONS

This application claims the benefit of Provisional Application No. 60/384,260, filed May 29, 2002, which is incorporated by reference herein.

BACKGROUND OF THE INVENTION

1. Field of the Invention

The present invention generally relates to a discreet removable chronological group indicator tab placed on a product at a predetermined depletion level and the method of the indicator. The tab will appear on the product when pulled from the dispenser to notify the consumer. The present invention relates to consumer products that have a predetermined depletion level where an indicator notifies one of the amounts of product left before the product is entirely depleted. It also has a process of placing the tab on the dispenser for future notification and recognition to aid in future replenishment and the advantages of a coupon to replenish the product.

2. Description of Related Art

When consumers come to the end of a box of facial tissue they don't know that they are running out of said product. They just take the last facial tissue with no indication that it is the last one. If there was a product quantity indicator tab that let the consumer know ahead of time they were running out of the product they could replace product without having the inconvenience of running out. The indicator tab would have a sticky adhesive substance that would stick to the product, but not ruin the product. The product quantity indicator tab would have the unit (say 10 tissues, 5 garbage bags, 10' of foil left, etc.) amounts left in container. The indicator could be decorative and placed on the outside of container i.e. foil box, KLEENEX® box, or paper towel roll. It would also have the product brand name on it, which the consumer could place in wallet for the next time they go to shop for said product. From the standpoint of the manufacturer, the indicator element encourages and facilitates repetitive purchases by consumers of the same exact product, thus ensuring brand loyalty on the part of the consumer. Brand recognition is a plus for manufacturers and consumers. The indicator tab would have a coupon with a UPC on it to ensure more customer incentive for repeat purchases and brand.

Manufacturers have developed several indicating means for web wound products and plurality of substrate products, many include treating finished rolls to create a series of printing ink to the surface to create indicia, but as more of the surface becomes covered manufacturing costs increase. Some cultures have an aversion to allowing inks to touch food or food preparation surfaces. Additionally, as the quantity of ink on the product increases a proportional amount of bleeding onto items and countertops may occur. Some products may include indicia throughout the entire product, which is expensive to the manufacturers and has less of an impact as an indication of depletion to the consumer that the product is actually nearing depletion. There also have been numerous indicators for web roll products such as laser or embossed indicia, but to implement these indicators are more costly and evasive to produce on the product by the manufacturer and therefore to the consumer. Also, many of the indicators and/or indicia run throughout the entire product so there is not the 'reminder' element of necessity for replacement of the product. Many of the prior art products require a dispenser with its own gauge indicia, which will be more costly to the manufacturer. And, the knowledge that the product has been depleted to where it needs to be replaced within a certain amount of uses may have a propensity of being overlooked by the consumer on these products. The product quantity indicator tab would have the removable adhesive part of the tab that has the product's name and an attached UPC coupon which offers incentive for the consumer to replace said web product or interleaved substrates/flat folded sheets.

Also, numerous products use windows to show the quantity of product left, yet these windows are more expensive to the manufacturer and not reliable to the consumer to indicate the exact amount of product remaining.

Up to now those skilled in the art never appreciated the advantage of the invention, although it is inherent much of the prior art is too cumbersome, ineffective or too complicated. The invention solves a long-felt, long-existing, but unsolved need that consumers could easily have attainable with a removable product quantity indicator tab that will notify them of depletion levels before the product is depleted.

The applicant's invention solves a different problem which is the product quantity indicator is removable, hence more effective as a notifier to the consumer because it can be placed somewhere obvious to replace the product before depletion. The whole of the invention is greater than the sum of its parts.

Among the aforementioned patents, U.S. Pat. No. 6,113,148, issued to Koranda et al on Sep. 5, 2000, discloses a shopping reminder system which includes a label having an indicator element to be peeled from the outside container's label and attached to a shopping list. However, it is only a shopping reminder system and not a depletion level quantity indicator to notify the consumer the product needs to be replaced.

In U.S. Pat. No. 6,282,807 of Johnson, issued Sep. 4, 2001, Johnson invented a rolled web in combination with a dispenser with gauge indicia applied to surface in a diagonal pattern along the length of the web indicating how much of the rail is remaining. However, the indicia does not have the depletion notification urgency element since the pattern runs throughout the entire product. Also, between the gauge indicia and the laser embossed pattern the manufacturing costs would be high and subsequently passed on to the consumer. The product quantity indicator tab is more accurate, and less expensive than the prior art i.e. and such different solved problems are recited in the claims. The indicia is not removable.

In U.S. Pat. No. 4,161,249 of Dashow, Dashow's web product with marker and method of manufacture are not removable to allow the consumer to purchase more. The adhesive on both sides of the bicycle tape (web product) indicate that the marker will notify the user, and to be used to adhere the tape to the new tape. Also, the marker is placed throughout the entire width of the web product, which would increase costs to the consumer.

In the dental floss indicator U.S. Pat. No. 5,365,874 of Dorfman, the indicator is not removable to allow the consumer to be notified to replace the dental floss before its depletion in other locations other than when only flossing their teeth. Also, many consumers are hesitant about hygiene standards regarding such dyes used on or in their products.

In U.S. Pat. No. 5,368,188 of Twardowski, folded product individual sheets include a visual indicator at the location, which should be removed by the first user with indicator for facilitating removal. The art is not actually removable, but an indicator of a particular spot where a consumer will pull the sheet from.

The aforementioned prior art references take mutually exclusive paths and reach different solutions to a similar problem. Since, they teach away from each other, it would not be logical to combine them. Those skilled in the art would find it physically impossible to combine the references in the manner suggested. If combined the references would produce an inoperative combination.

In U.S. Pat. No. 2,853,042 of Rifkin, magnetic tape indexing means the principal object of the invention is to provide new and improved indexing means for magnetic recording. The invention is not to indicate depletion levels. The tabs or guides may be used to splice pieces of tape together. The tabs may be removed or left on the magnetic indexing tape when reusing the tape.

U.S. Pat. No. 5,507,425 of Ziglioli, is a stapling machine which has marking on part of a constant tension spring visible from the exterior through a window provided for this purpose. Unfortunately, windows are expensive for manufacturers and therefore to consumers. Also, windows are not accurate means of showing depletion levels and this type of numbered ribbon would not work on substrates or web rolled products.

None of the above inventions and patents, taken either singly or in combination, are seen to describe the instant invention as claimed.

As all the prior art has been listed the large number of references must be combined to meet the invention, this is the evidence of non-obviousness. Even if combined the references would not meet the claims.

Each reference is complete and functional in itself, so there would be no reason to use parts from or add or substitute parts to any reference.

An element of prior art lacks any suggestion that the references should be modified in a manner required to meet the claims. In light of shortcomings of indicators in prior art it is desirable to have an indicator tab that is simple to apply to a product while being readily understood by a common consumer to remove at the predetermined level. It also is advantageous to have the indicator tab applied to the product in a noninvasive manner.

The present invention overcomes the disadvantages of the prior art, while providing above-mentioned desirable features for product depletion indication and of consumer incentive with the UPC barcode coupon to readily replace the exact consumer products.

The present invention is classified in a crowded art of which none of the prior art is able to solve the problem of product depletion with a removable tab, therefore a small step forward should be regarded as significant.

OBJECTS OF THE INVENTION

Accordingly, it is a principal object of the invention to provide a convenience to the consumer by implementing a removable product quantity indicator tab that enables a consumer to easily ascertain that the product is nearly depleted well before its actual depletion.

It is therefore desirable to have a removable product quantity indicator tab having all of the benefits and none of the drawbacks of the related art.

It is another object of the invention to provide a discreet removable product quantity indicator that may be easily and inexpensively manufactured, marketed and implemented.

It is a further object of the invention to provide a product quantity indicator tab with attached UPC barcode coupon that helps ensure incentive for brand loyalty in consumers that will be greatly advantageous to the manufacturer.

Still another object of the invention is to provide a product quantity indicator tab that may easily and conveniently be used by consumers.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The purpose and advantages of the invention will be set forth in and apparent from the description and drawings that follow, as well as will be learned by practice of the invention disclosed and claimed herein.

SUMMARY OF THE INVENTION

When consumers come to the end of a container of multiple products, such as a roll of a web of aluminum foil or a box of facial tissue they don't know that they are running out of the product. They just take the last facial tissue with no indication that it is the last one. This is often inconvenient, and distressing to a person afflicted with an acute nasal infection, allergies or a cold with attendant runny nose and irritated nasal passages.

Therefore, in keeping with the aforementioned objects and others which may become apparent, the present invention is a product quantity indicator tab that lets the consumer know ahead of time that they are running out of the product, so that they can replace the product without having the inconvenience of running out. The indicator tab includes a sticky substance (like on a POST-IT®) that sticks to the product, but does not ruin the product. The product quantity indicator tab has the unit (i.e. 10 tissues, 5 garbage bags, 10' of foil left, etc.) amounts of the products left in container. It can alternatively have the product brand name on it, which the consumer can place in the consumer's wallet for the next time the consumer goes to shop for the product. Brand recognition is a plus for manufacturers and consumers. Alternatively, the indicator tab can have a coupon with an optional UPC code printed on it to ensure more customer loyalty.

BRIEF DESCRIPTION OF THE DRAWINGS

In describing the preferred embodiment, reference is made to the accompanying drawings wherein like parts have like reference numerals, and wherein:

FIG. 1 is a perspective view of a rolled product in a dispenser utilizing the depletion indicator of this invention;

FIG. 2 is an end view of the product of FIG. 1;

FIG. 3 is a crossectional edge view of a detail as indicated in plane of FIG. 1 and the dashed circle of FIG. 2;

FIG. 4 is a top view of the removable coupon of this invention;

FIG. 5 is an edge view of the coupon illustrating the location of the temporary adhesive;

FIG. 6 is a bottom view of the removable coupon showing the adhesive section;

FIG. 7 is a perspective view of this invention as applied to a box of tissues;

FIG. 8 is a side phantom view showing the internal contents of the tissue box of FIG. 7, and FIG. 9 is a crossectional edge view of a detail as indicated by the plane in FIG. 7 and the dashed circle of FIG. 8.

It should be understood that the drawings are not to scale. While other plan and section views of the preferred embodiments, as well as considerable mechanical details of a device for applying indicia to a product have been omitted, such details are not considered necessary for one skilled in the art to obtain a full and complete understanding of the invention disclosed and claimed herein. It should also be understood that the present invention is not limited to the preferred embodiments illustrated.

DETAILED DESCRIPTION OF THE PREFERRED EMBODIMENTS

Rolled web products using the depletion indicator coupon of this invention include a variety of common household products such as aluminum foil, plastic film, wax paper, paper towels, plastic garbage bags, etc. FIGS. 1–6 illustrate the invention in use on one of these types of product, namely a package of opaque metal foil. Other products with individual sheets or flat items are stacked inside dispenser boxes. A representative example of such a product category is a box of tissues; this application is illustrated in FIGS. 7–9.

FIG. 1 shows a dispenser box 1 with a user's hand 3 pulling out a length of aluminum foil 2. A depletion indicator coupon 4 is just coming into view as foil 2 is pulled out.

The end view of FIG. 2 shows the instant that coupon 2 emerges from dispenser 1.

FIG. 3 shows a detailed crossection coupon 4 attached at site 8 to foil 2. Coupon substrate 7 is typically paper, but can also be a thicker cardboard or a more flexible plastic such as polyethylene. The temporary adhesive is such that it has a high bonding affinity to substrate 7, but a weak bond to the product such as foil 2. It can be easily peeled free of foil 2 and it will then adhere with a similar weak bond to a wide variety of surfaces such as paper, plastic, or glass. Examples of this type of adhesive are commonly found on "POST-IT Notes"™ from 3M Company or as a coating with a release liner for temporary attachment to undergarments as found on "LIGHTDAYS"™ pads from Kotex Corporation.

Other types of temporary affixing means can be used such as electrostatic pinning adhesives as noted in U.S. Pat. No. 6,159,596 of Calhoun assigned to 3M Innovative Properties Company of St. Paul, Minn. or U.S. Pat. No. 6,306,072 of Ojeda, also assigned to 3M Innovative Properties of St. Paul, Minn.

FIG. 4 is a top view of coupon 4 illustrating the features of this invention. The largest region 11 is reserved for advertising showing a picture of the product or logo along with the coupon "deal". Another prominent feature is the depletion indication 10 which tells the user how much product is left in the dispenser (here "3 feet" of foil are indicated). For automatic machine processing of the coupon, a bar code 12 which includes UPC information augmented with coupon information is included. Matrix codes or other machine-readable indicia can be used as a substitute for the bar code in the future. Even passive radio frequency tags (RF Tags) have been touted as a substitute for the bar code; these can also be attached to substrate 7. In any case, the code should include product identification, coupon "deal" or amount, and a coupon expiration date (if used). Any inks or dyes used with food or food-contact products should be rated "food grade", while all materials used for coupon 4 production should also be hypo-allergenic.

FIG. 5 and the bottom view of FIG. 6 show the portion 15 of coupon 4 covered with temporary adhesive.

FIG. 7 shows a common tissue box 20 with a tissue 21 being pulled out revealing depletion indicator coupon 4.

The phantom end view of FIG. 8 shows a stack 24 of tissues within dispenser box 20.

The detailed crossection of FIG. 9 shows the attachment of coupon 4 to tissue 21 at site 22. While a temporary adhesive with less adhesion than that used for the foil application can be used here, another solution to the delicate product problem is to attach a small patch of soft plastic release liner to cover adhesive patch 15 of coupon 4. Then this liner patch can be permanently attached to a tissue using a pressure sensitive adhesive layer on its opposite surface in the same manner that coupon 4 is normally attached. When coupon 4 is peeled from tissue 21, the release liner patch (not shown) will remain attached to the tissue; this would not interfere with the use of this single sheet of tissue 21.

For purposes of this invention, "removably affixed" means that the indicator tab may be peeled, by hand, off of product without damaging it. The indicator tab has the brand name or trademark of the product.

The above detailed description of this invention has been given for ease of understanding only. No unnecessary limitations should be understood therefrom, as modifications will be obvious to one skilled in the art.

Similar reference characters denote corresponding features consistently throughout the attached drawings. It is to be understood that the present invention is not limited to the sole embodiment described above, but encompasses any and all embodiments within the scope of the stated claims.

What is claimed is:

1. A discreet removable indicator tab on a product that represents notification to a consumer that the product is at a predetermined depletion level before the product is completely depleted, said indicator tab comprising:

a removable tab affixed to the product, said removable tab having indicia indicating the amount of said product remaining before actual depletion, said removable tab having a bottom surface with an affixing means, and a top surface having said product name or indicia thereon representing said product and indicia indicating the amount of product remaining; wherein said indicator tab is removable from said product at the predetermined depletion level by said affixing means;

said affixing means being adapted to removably affix said indicator tab to a dispenser of the product for future notification or in a wallet as a reminder or on a shopping list after removal of said indicator tab from said product;

and said indicator tab includes said product type or an image imprinted on said indicator tab.

2. The product quantity indicator tab as in claim 1 wherein said tab has a removable redeemable coupon attached by adhesives.

3. The product quantity indicator tab as in claim 2 wherein said removable coupon has permanent ink Universal Product Code (UPC) barcode.

4. The product quantity indicator according to claim 1, wherein said indicator tab represents a notification of said product's predetermined depletion level and a predetermined indicia indicating that said product will need to be replaced without having to run out of said product.

5. The product quantity indicator tab according to claim 1, wherein said indicia includes a representation of said indicator in Braille.

6. The product quantity indicator tab according to claim 1, wherein said affixing means is a the non-drying adhesive that allows said indicator tag may be repeatedly reused.

7. The product quantity indicator tab according to claim 1, wherein said affixing means utilizes a temporary adhesive such that said indicator tab may be repeatedly reused.

8. The product quantity indicator tab according to claim 1 wherein said tab includes at least one of decorative or theme indicia.

9. The depletion reminder of claim 1 in which said tab is imprinted with bar coded product information.

10. The depletion reminder of claim 1 in which said tab is imprinted with a discount purchase offer.

11. The depletion reminder of claim 1 in which said tab is imprinted with a sales offer.

12. The depletion reminder of claim 1 in which is product is on a roll being dispensed from a container having a cutter for separating an amount selected by a user.

13. The depletion reminder of claim 1 in which said product comprises stacked or interleaved members.

14. A depletion reminder comprising:

means for dispensing a finite quantity of a product;

a removable tab mounted on a portion of said product in advance of exhaustion of said product wherein said tab has an adhesive patch on one side and a release liner covering said adhesive patch, said release liner being permanently attached to said product, said tab being releasable from said release liner; and, said tab displaying information indicating the amount of said product remaining in said dispensing means.

* * * * *